US011542762B2

(12) United States Patent
Moore

(10) Patent No.: US 11,542,762 B2
(45) Date of Patent: Jan. 3, 2023

(54) MULTI-TOOTH JAW, TORQUE STOPPER DEVICE AND REPAIR KIT THEREOF FOR PREVENTING ROTATION OF DOWNHOLE TOOLS SUSPENDED IN WELLBORE CASING

(71) Applicant: Excalibre Downhole Tools Ltd., Airdrie (CA)

(72) Inventor: Edward L. Moore, Foothills (CA)

(73) Assignee: Excalibre Downhole Tools Ltd., Airdrie (CA)

( * ) Notice: Subject to any disclaimer, the term of this patent is extended or adjusted under 35 U.S.C. 154(b) by 0 days.

(21) Appl. No.: 17/316,805

(22) Filed: May 11, 2021

(65) Prior Publication Data

US 2021/0404276 A1 Dec. 30, 2021

(30) Foreign Application Priority Data

Jun. 29, 2020 (CA) ..... 3085090

(51) Int. Cl.
*E21B 23/00* (2006.01)
*E21B 41/00* (2006.01)
*E21B 11/00* (2006.01)

(52) U.S. Cl.
CPC ..... *E21B 23/00* (2013.01); *E21B 11/00* (2013.01)

(58) Field of Classification Search
CPC ..... E21B 23/00; E21B 23/01; E21B 41/00
See application file for complete search history.

(56) References Cited

U.S. PATENT DOCUMENTS 4,499,799 A * 2/1985 Bordages ..... B25B 13/5083 81/446
5,623,991 A * 4/1997 Jani ..... E21B 23/01 166/216
5,636,690 A * 6/1997 Garay ..... E21B 23/01 166/243
6,073,693 A * 6/2000 Aldridge ..... E21B 23/01 166/217
6,155,346 A * 12/2000 Aldridge ..... E21B 23/01 166/243

(Continued)

FOREIGN PATENT DOCUMENTS

CA 2264467 C 2/2002
CA 2373734 C 12/2005
CA 2386026 C 1/2007

*Primary Examiner* — Daniel P Stephenson
(74) *Attorney, Agent, or Firm* — ATMAC Patent Services Ltd.; Andrew T. MacMillan

(57) ABSTRACT

A multi-tooth jaw for a torque stopper device prevents rotation of downhole tools suspended in a wellbore casing. The jaw includes a base for positioning adjacent an outside wall of the torque stopper and a hinge connection allowing the jaw to pivot around an axis of rotation running lengthwise through the base. The jaw further includes a plurality of radial tips, i.e., teeth, each a different distance from the axis of rotation. When viewed from a side with the axis of rotation being a point around which the jaw pivots, the tips are in ascending order of distance with a first, leading tip having a shortest distance from the axis of rotation as the jaw pivots from a stowed to a deployed position. A torque stopper device with the multi-tooth jaw supports a range of casing internal diameters. A repair kit allows swapping a one-tooth jaw with the multi-tooth jaw.

9 Claims, 14 Drawing Sheets

(56) References Cited

U.S. PATENT DOCUMENTS

| | | | | |
|---|---|---|---|---|
| 6,189,610 | B1 * | 2/2001 | LaClare | E21B 23/01 166/208 |
| 6,318,459 | B1 * | 11/2001 | Wright | E21B 23/01 166/117.6 |
| 6,318,462 | B1 * | 11/2001 | Tessier | E21B 23/01 166/243 |
| 6,681,853 | B2 * | 1/2004 | Doyle | E21B 23/01 166/241.1 |
| 6,968,897 | B2 * | 11/2005 | Doyle | E21B 23/01 166/241.1 |
| 7,900,708 | B2 * | 3/2011 | Obrejanu | E21B 23/01 166/216 |
| 9,494,019 | B2 * | 11/2016 | Wold | E21B 23/01 |
| 10,378,292 | B2 * | 8/2019 | Shahipassand | E21B 17/1064 |
| 2002/0014335 | A1 * | 2/2002 | Doyle | E21B 23/01 166/241.1 |
| 2021/0404276 | A1 * | 12/2021 | Moore | E21B 23/01 |

* cited by examiner

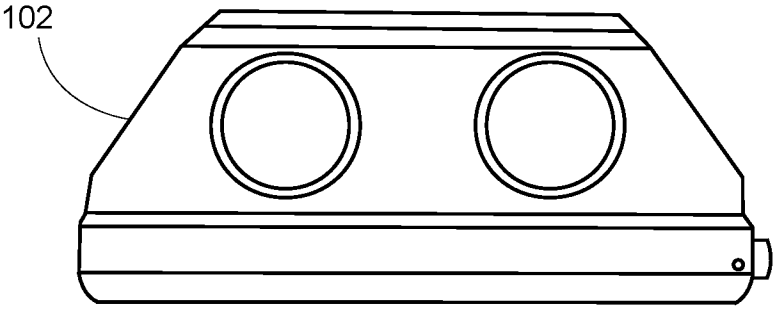
FIG. 2 - Prior Art
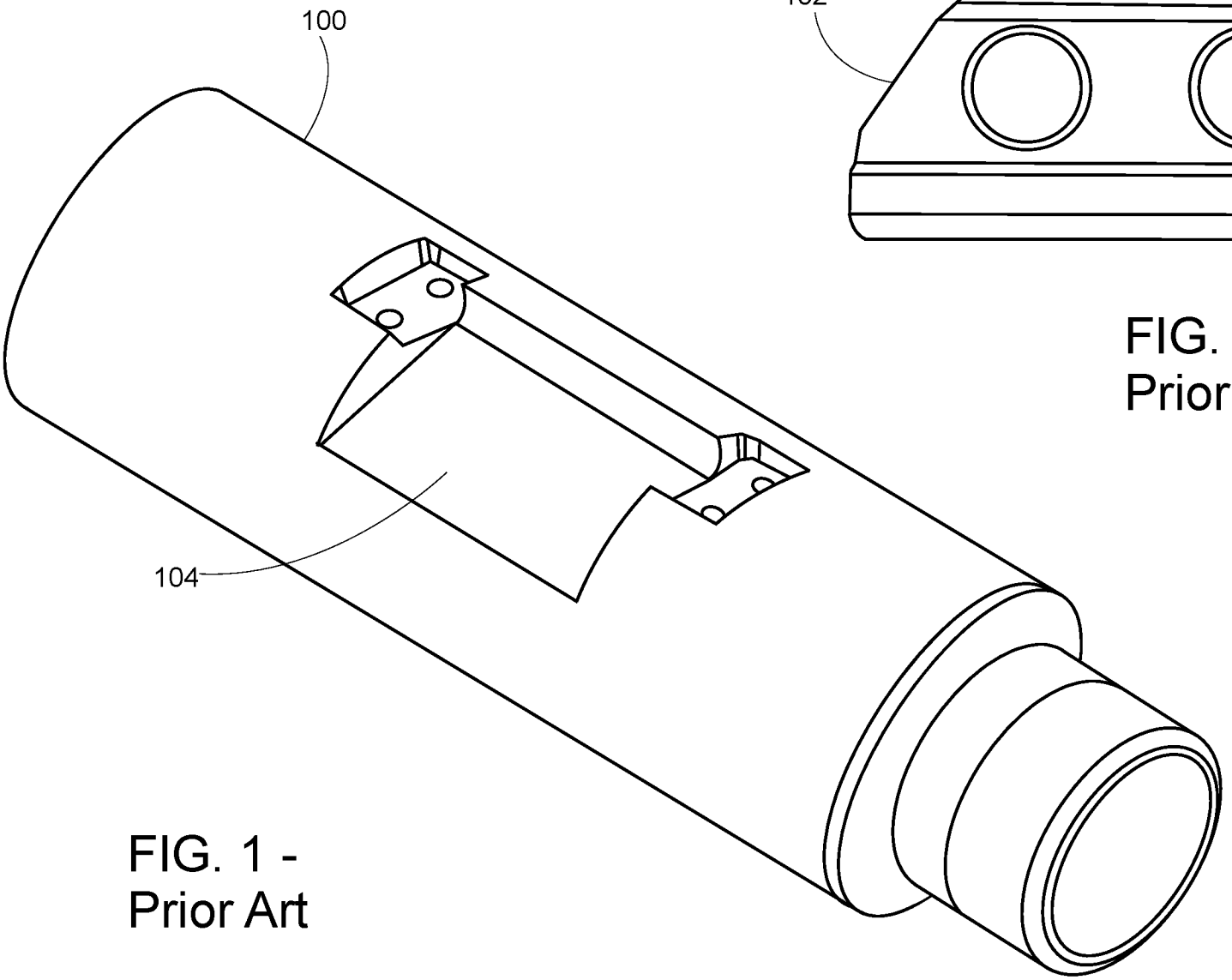
FIG. 1 - Prior Art

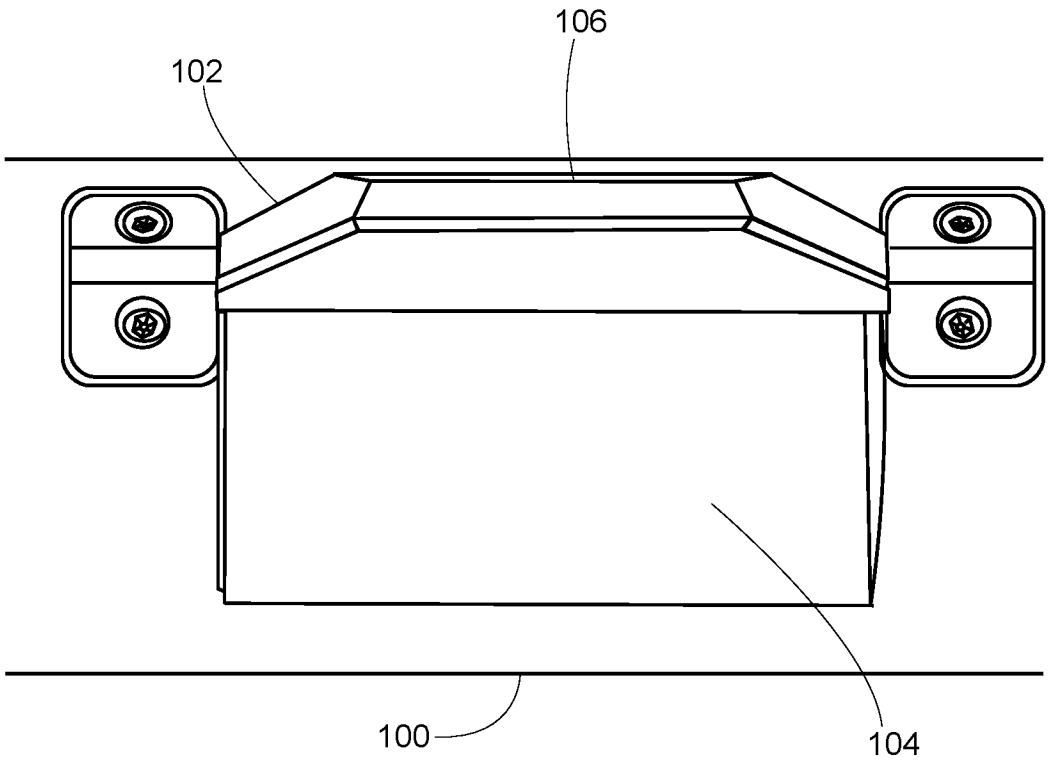
FIG. 4 - Prior Art
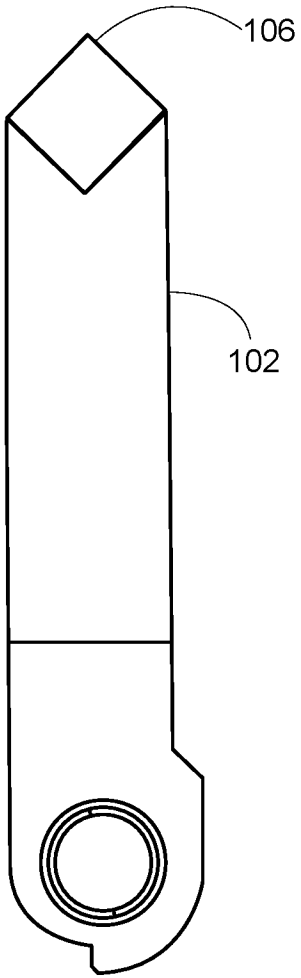
FIG. 3 - Prior Art

MULTI-TOOTH JAW, TORQUE STOPPER DEVICE AND REPAIR KIT THEREOF FOR PREVENTING ROTATION OF DOWNHOLE TOOLS SUSPENDED IN WELLBORE CASING

CROSS-REFERENCE TO RELATED APPLICATIONS

This application claims the benefit of priority of Canadian Patent Application No. 3,085,090 filed Jun. 29, 2020, which is incorporated herein by reference.

BACKGROUND OF THE INVENTION

(1) Field of the Invention

The invention pertains generally to oil and gas production. More specifically, the invention relates to a torque stopper device for preventing rotation of a tubing string or progressive cavity pump in the bore of a casing string.

(2) Description of the Related Art

Oil is often pumped from a subterranean reservoir using a progressive cavity (PC) pump. The stator of the PC pump is threaded onto the bottom of a long assembled string of section tubing. A rod string extends downhole and drives the PC pump rotor. Large reaction or rotator rotational forces can cause the tubing or PC pump stator to unthread, resulting in loss of the pump or tubing string.

Anti-rotation tools with a pivotable jaw (also sometimes referred to as a pivotable door) are described, for example, in Canadian Patent No. 2,264,467 entitled "DOWNHOLE ANTI-ROTATION TOOL", Canadian Patent No. 2,373,734 entitled "DOWNHOLE ANTI-ROTATION TOOL", and Canadian Patent No. 2,386,026 entitled "IMPROVED ANTI-ROTATION TOOL". These tools are commonly referred to as torque stopper devices and/or torque anchor devices.

FIG. 1 illustrates the body of a torque stopper device 100 according to the prior art and FIG. 2 illustrates a front view of a jaw/door 102 for the torque stopper device of FIG. 2 according to the prior art. FIG. 3 illustrates a side view of the jaw 102 of FIG. 2, and FIG. 4 illustrates a top view of the jaw 102 of FIG. 2 after joined to the outside wall 104 of the torque stopper device 100 and pivoted away from the outside wall 104 in a deployed position.

Complete details of the operation of the torque stopper device 100 and jaw 102 are found in the above-mentioned prior art patents; however, their operation can be briefly described as follows.

When the torque stopper 100 is rotated counterclockwise (as viewed from the surface looking down the wellbore), the jaw 102 is pivoted toward a stowed position where it pivots toward the housing 104 of the torque stopper body 100 and does not interfere with rotation. In this way, the sectional tubing down the wellbore can freely be rotated in the counterclockwise direction. However, when the torque stopper 100 is rotated in the clockwise direction, the jaw 102 is pivoted away from the torque stopper body 100 into a deployed position as shown in FIG. 4. In this position, the radial tip 106 of the jaw 102 catches on the wellbore casing and the jaw 102 attempting to further open pushes against the torque stopper body 100 such that an opposite side of the body 100 abuts against the casing. In this configuration, the torque stopper 100 with extended jaw is jammed up in the wellbore casing and cannot rotate. Thus, the torque stopper 100 prevents the entire tubing string from rotating in the clockwise direction.

To successfully achieve the desired goal of stopping rotation in the clockwise direction, care must be taken to ensure that the diameter of the tubular body of the torque stopper 100 combined with the length of the jaw 102 in the deployed position (which may be either a partially or fully extended) is sufficient to catch the radial tip 106 on the casing and jam (i.e., stop) the rotation. If the combined width of the torque stopper body 100 and jaw 102 in the fully extended position is less than the internal diameter of the casing, the torque stopper device 100 will be unable to prevent rotation. However, if the jaw 102 is too long such that the combined width is much greater than an ideal threshold width, the torque stopper device 100 will again be unable to prevent rotation because the jaw 102 will simply not be able to pivot enough such that the radial tip 102 can properly catch the casing wall. The tip 106 may catch partially, but the hold will not be solid and failure may later occur due to vibrations of the PC pump.

In other words, to ensure proper operation, the size of the torque stopper 100 and accompanying jaw 102 must be selected in dependence upon the casing outer diameter size and also the casing weight. Casing outer diameter directly affects the inner diameter, and higher casing weight also affects the inner diameter because larger weight equates to thicker casing walls thereby reducing the inner diameter.

The following table provides an example of an ordering document utilized to select a model of the torque stopper tool 100 (i.e., "Tool model") given a particular casing outer diameter ("Csg O.D."), casing weight ("Csg Wt"), and thread connection size. Each different tool model number has a different sized jaw/door with a note shown in the last column that some casing parameters require further special jaw/door changes for even a same tool model as listed in the below table.

| Casing | | | Tool | |
|---|---|---|---|---|
| Csg O.D. (inch) | Csg Wt (lbs/ft) | Thread connection | Model | Door modification/ change requirements |
| 4½ | 8.77-10.5 | 2⅞ | TX4-2 | |
| 4½ | 8.77-13.5 | 2⅜ | TX4-2⅜ | |
| 5½ | 13-17 | 2⅞ | TX5-2 | |
| 5½ | 20-24 | 2⅞ | TX5-2 | 20-24 lbf Door |
| 5¾ | 14-19.5 | 2⅞ | TX5-2 | 5¾ door |
| 5¾ | 22.5-25.2 | 2⅞ | TX5-2 | |
| 5½ | 9-15.5 | 3½ | TX5-3 | |
| 6⅝ | 20-24 | 2⅞ | TX6-2 | |
| 6⅝ | 20-24 | 3½ | TX6-3 | |
| 6⅝ | 24-28 | 3½ | TX6-3 | 24-28 lbf door |
| 7 | 22-26 | 2⅞ | TX7-2 | |
| 7 | 26-29 | 2⅞ | TX7-2 | N80 door |
| 7 | 22-26 | 3½ | TX7-3 | |
| 7 | 26-29 | 3½ | TX7-3 | N80 door |
| 7⅝ | 26.4-42.5 | 3½ | TX7 .625-3 | Regular TX7 door |
| 7⅝ | 24-34 | 4½ | TX7-4 | N80 door |
| 7⅝ | 35.5-39 | 4½ | TX7-4 | |
| 8⅝ | 32-54 | 3½ | TX8-3 | |
| 9⅝ | 36-47 | 3½ | TX9-3 | |
| 9⅝ | 36-47 | 4½ | TX9-4 | |
| 10¾ | 45-60.7 | 3½ | TX10-3 | Regular TX8 door |

One problem with the current prior art torque stopper devices 100 with pivotable jaws 102 is that the selection of parts is time consuming and confusing. Even for trained individuals, it is possible that wrongly sized parts may be selected and utilized in wellbore where the casing internal diameter leads to the tool 100 not working well. In this event, the torque stopper device 100 may prevent downhole tool rotation for a period of time and then fail. The reason for failure may not be apparent to people working on site and replacement parts may be installed with the same incorrectly sized components.

Another problem with the current prior art torque stopper devices 100 is availability of properly sized parts. Although many countries utilize standard casing sizes and weights, the sizes are not universal. For example, seven-inch casing may have a range of weights from 17 lbs/ft all the way to 32 lbs/ft. In some cases, cheaper casing may be available with non-standard sizes. To give some examples, Canada uses 7.0"×17#–26# casings, and Colombia uses –7.0"×22#–26# and 7.0"×26#–29# casings. Colombia also has 7.0"×32# casings, but, as shown in the above chart, there is simply no available combination of tool 100 and jaw/door 102 size that will accommodate such casing OD and weight. As shown by these examples, there are many different sized doors/jaws required just for 7.0" casings.

BRIEF SUMMARY OF THE INVENTION

According to an exemplary embodiment of the invention there is disclosed a multi-tooth jaw for a torque stopper device preventing rotation of one or more downhole tools suspended in a wellbore casing. The multi-tooth jaw includes a base for positioning adjacent an outside wall of the torque stopper device and a hinge connection on the base for joining with a corresponding hinge connection on the outside wall of the torque stopper device to thereby allow the multi-tooth jaw to pivot around an axis of rotation running lengthwise through the base. The multi-tooth jaw further includes a plurality of radial tips each extending laterally from the base a different distance from the axis of rotation.

According to an exemplary embodiment of the invention there is disclosed a torque stopper device comprising a multi-tooth jaw as disclosed herein.

According to another exemplary embodiment of the invention there is disclosed a repair kit for a torque stopper device, the repair kit including a multi-tooth jaw as disclosed herein.

According to yet another exemplary embodiment of the invention there is disclosed a method of utilizing the repair kit to replace a prior art one-tooth jaw of a torque stopper device with a newer multi-tooth jaw as disclosed herein.

These and other advantages and embodiments of the present invention will no doubt become apparent to those of ordinary skill in the art after reading the following detailed description of preferred embodiments illustrated in the various figures and drawings.

BRIEF DESCRIPTION OF THE DRAWINGS

The invention will be described in greater detail with reference to the accompanying drawings which represent preferred embodiments thereof:

FIG. 1 illustrates a perspective view of the body of a torque stopper device according to the prior art.

FIG. 2 illustrates a front view of a jaw/door for the torque stopper device of FIG. 2 according to the prior art.

FIG. 3 illustrates a side view of the jaw of FIG. 2.

FIG. 4 illustrates a top view of the jaw of FIG. 2 after joined to the outside wall of the torque stopper device and pivoted away from the outside wall in a deployed position according to the prior art.

DETAILED DESCRIPTION

Figure 5:
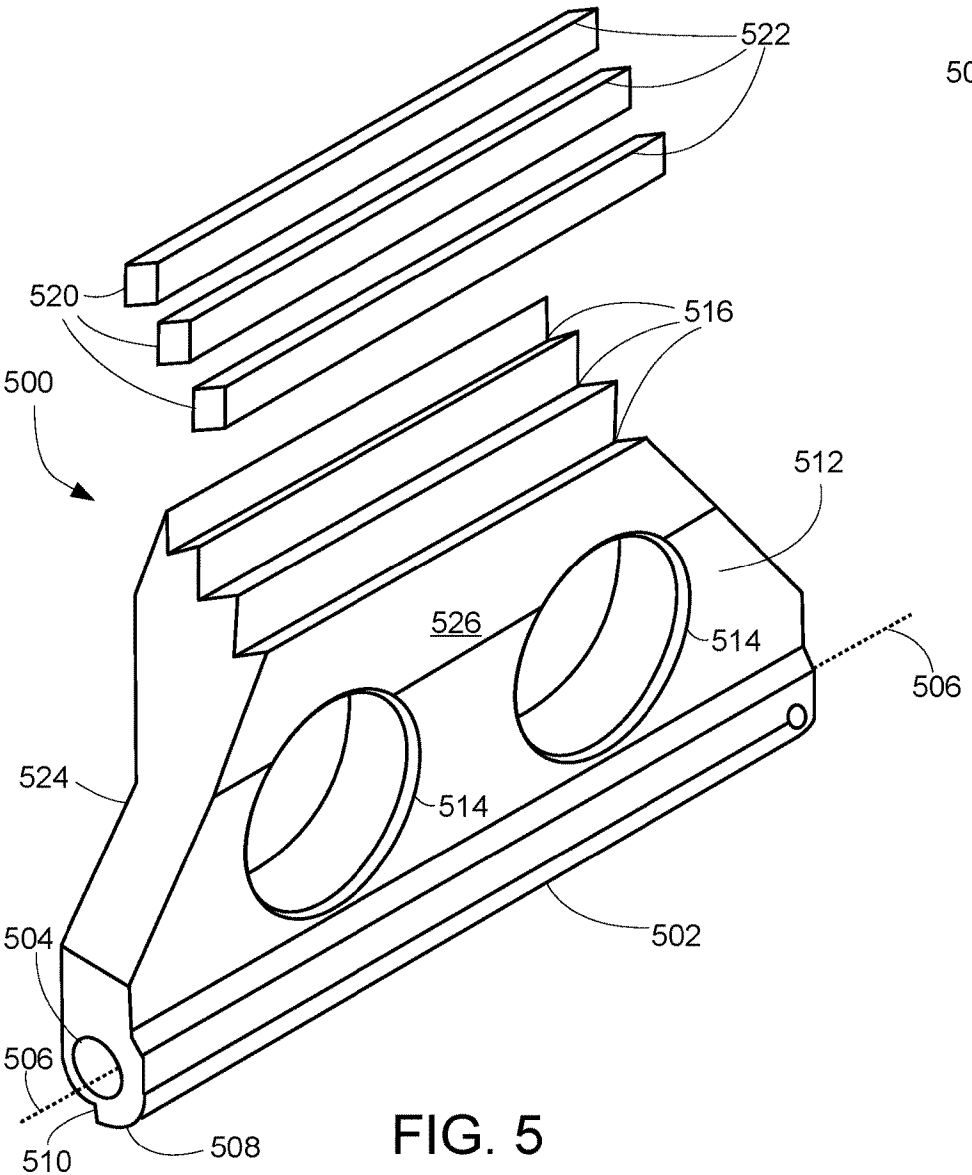
FIG. 5 illustrates an exploded perspective view of a multi-tooth jaw/door for a torque stopper device prior to assembly according to an exemplary embodiment of the present invention.

FIG. 5 illustrates an exploded perspective view of a multi-tooth jaw/door 500 prior to assembly for a torque stopper device 550 (see FIG. 14) according to an exemplary embodiment of the present invention. For ease of description, the jaw/door 500 is hereinafter referred to as a "jaw"; however, it is to be understood that another common name for the jaw 500 is "door"; the terms jaw and door are generally speaking interchangeable in this description.

As illustrated, the multi-tooth jaw 500 includes an elongated base 502 with hinge pin holes 504 on either side for insertion of hinge pins (not shown). An axis of rotation runs 506 lengthwise through the base 502, and the base 502 has a rounded bottom 508 with a stopper ledge 510 for impacting a corresponding stopper ledge on the body of the torque stopper device 550 to prevent over rotation of the jaw 500 past a threshold angle such as ninety degrees from the housing wall 552 (see FIG. 14). The body 512 of the jaw 500 is a trapezoidal shape, and, to reduce the weight of the jaw 500, the jaw body 512 includes two weight reduction holes 514. The features of the jaw 500 described thus far are similar to those of the prior art jaw 102 shown above and further described in the above-identified prior art patents and thus a repeated, more-detailed description of these aspects is omitted herein for brevity.

Where the jaw 500 of FIG. 5 differs greatly with the prior art jaw 102 is the addition of a plurality of three valleys 516 on a top side 518 of the jaw body 512 opposite the base 502. A respective plurality of three tungsten carbide inserts 520 are mounted into these valleys 516 thereby forming a plurality of three radial tips 522 being the upper edge lines of the inserts 520 which run parallel to the axis of rotation 506 but are different distances from the axis of rotation 506. These three radial tips 522 are the three "teeth" of the multi-tooth jaw of this embodiment.

Figure 6:
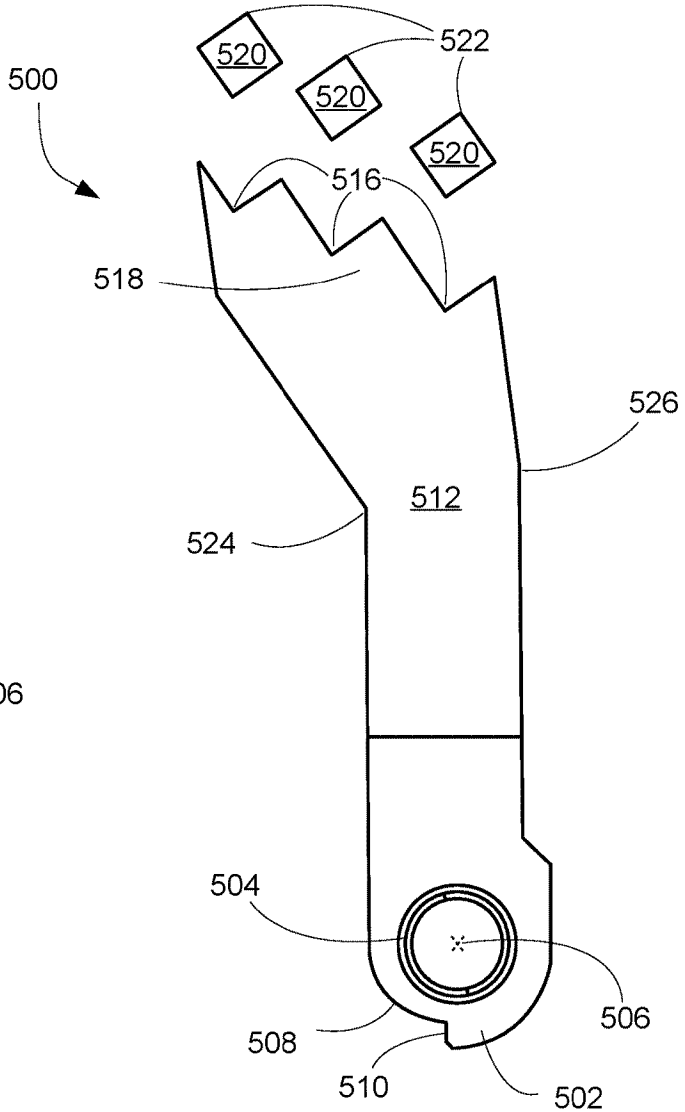
FIG. 6 illustrates an exploded side view of the jaw of FIG. 5 prior to assembly.

FIG. 6 illustrates an exploded side view of the jaw 500 of FIG. 5 prior to assembly. This view illustrates the jaw 500 from the side with the axis of rotation 506 being the point around which the jaw pivots 500. From the side, each of the carbide inserts 520 appears as a square for sitting in a corresponding ninety-degree valley 516.

An inner side 524 of the jaw 500 that will lie against the outside housing wall 552 of the torque stopper device 550 while the jaw 500 is pivoted to a fully stowed position has a concave shape. The concave shape helps the jaw 500 stay close to the housing wall 552 and reduce the combined width of the torque stopper device 550 with jaw 500 in the stowed position. Likewise, an outer side 526 of the jaw 500 facing the wellbore casing while the jaw is pivoted in the stowed position has a convex shape. The slight convex shape again helps the outside of the jaw 500 follow the shape of the torque device body when the jaw 500 is in the stowed position. This arcuate shape of the jaw 500 can help the jaw 500 in the stowed position from interfering with rotation of the tool string in the counterclockwise direction.

Figure 7:
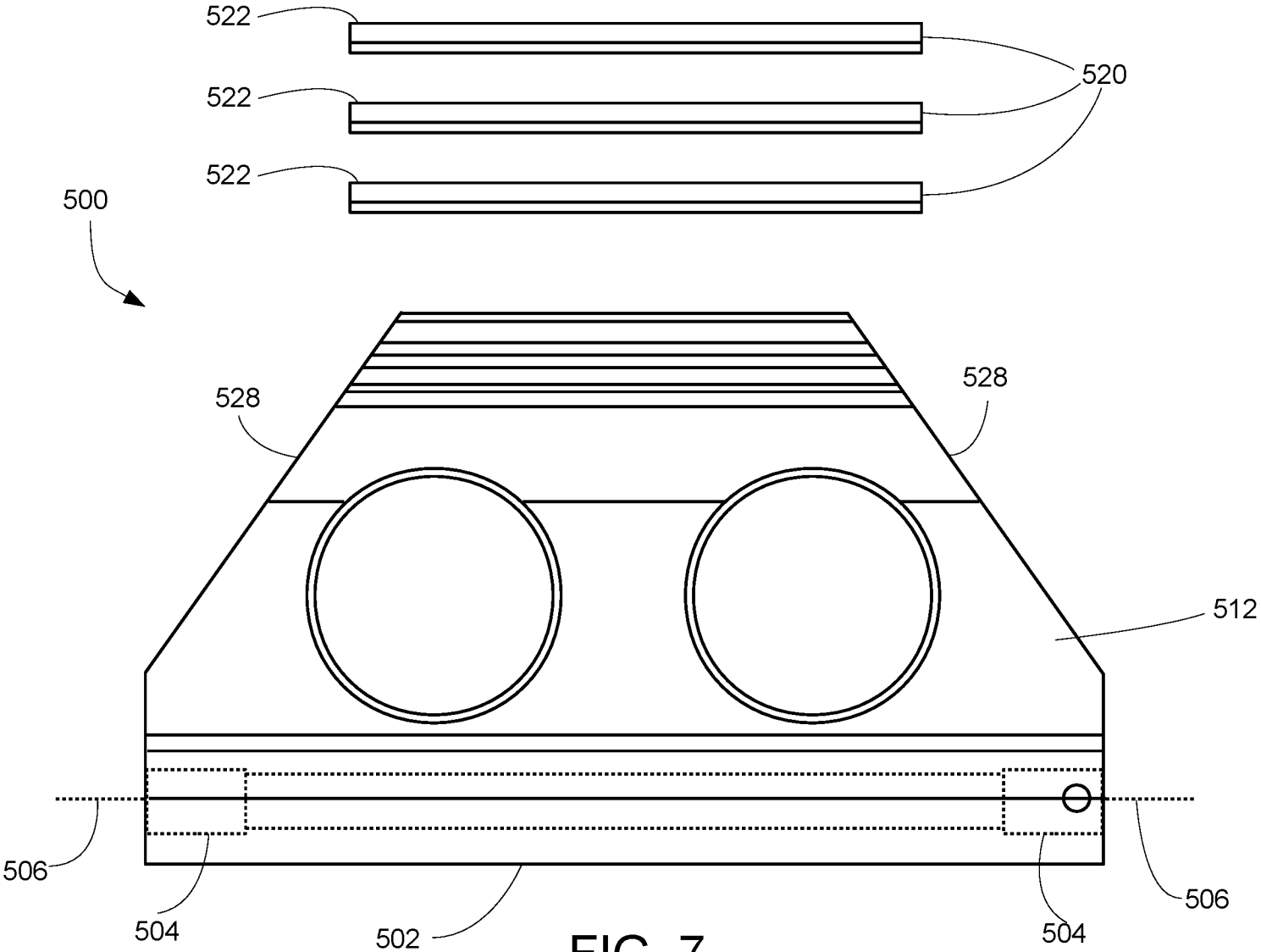
FIG. 7 illustrates an exploded front side view of the jaw of FIG. 5 prior to assembly.

FIG. 7 illustrates an exploded front side view of the jaw 500 of FIG. 5 prior to assembly. As shown, in this embodiment each of the carbine inserts 520 is a same length and all three inserts 520 extend past the side edge 528 of the trapezoidal shaped jaw body 512. The body of the jaw 512 is generally shaped as a trapezoid in this embodiment and incidental pushing or impacts on the angled sidewalls 528 of the jaw 500 generally act to push the jaw 500 toward the stowed position.

In some embodiments, a spring (not shown) within the hinge joints by the hinge pin holes 504 where the jaw joins to the torque stopper body 551 (see FIG. 14) will act to continually try and pivot the jaw 500 into the deployed position. In other words, the spring pushes the jaw outwards such that the jaw pivots away from the torque stopper outer housing toward the casing. See the above-identified prior art patents for further details of the spring structure and functionality; a repeated description is omitted herein for brevity.

Figure 9:
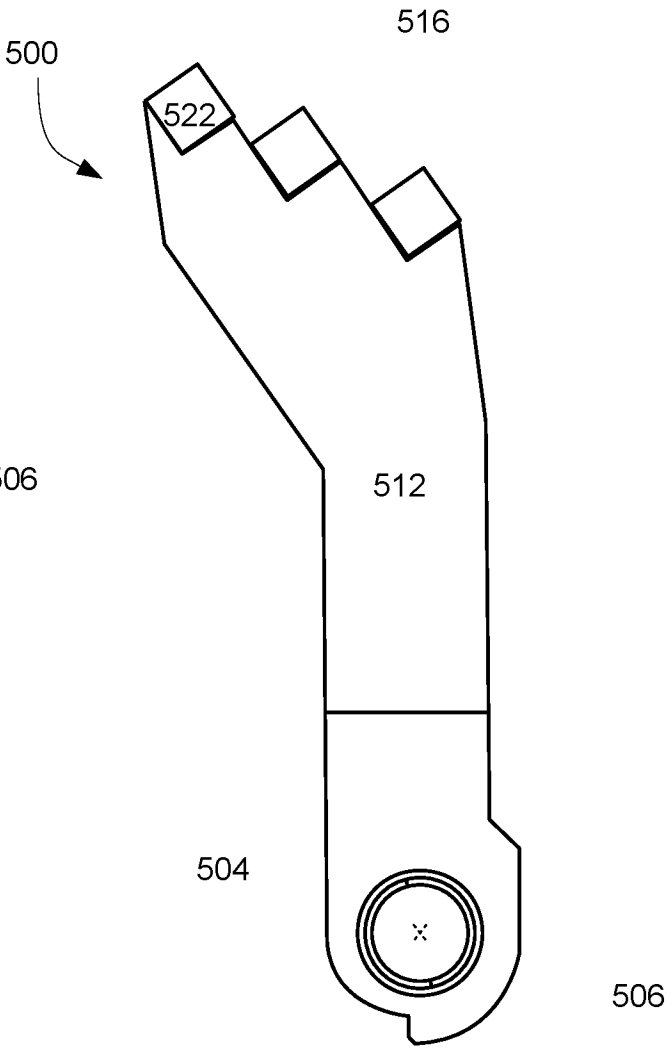
FIG. 9 illustrates a side view of the assembled three-tooth jaw of FIG. 8 prior to filing down the carbide tips.
Figure 8:
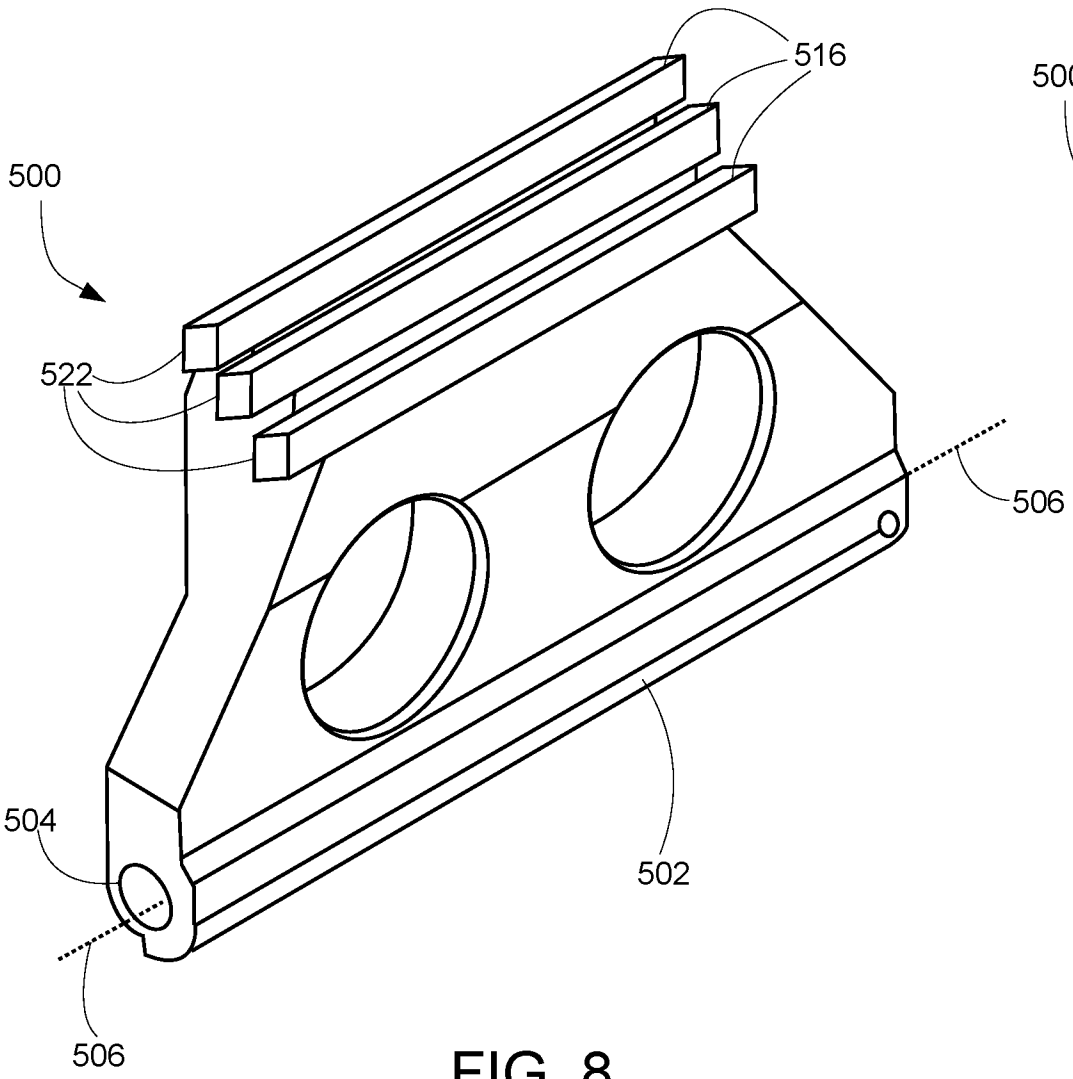
FIG. 8 illustrates a perspective view of a three-tooth jaw assembled but prior to filing down the carbide inserts according to an exemplary embodiment.
Figure 10:
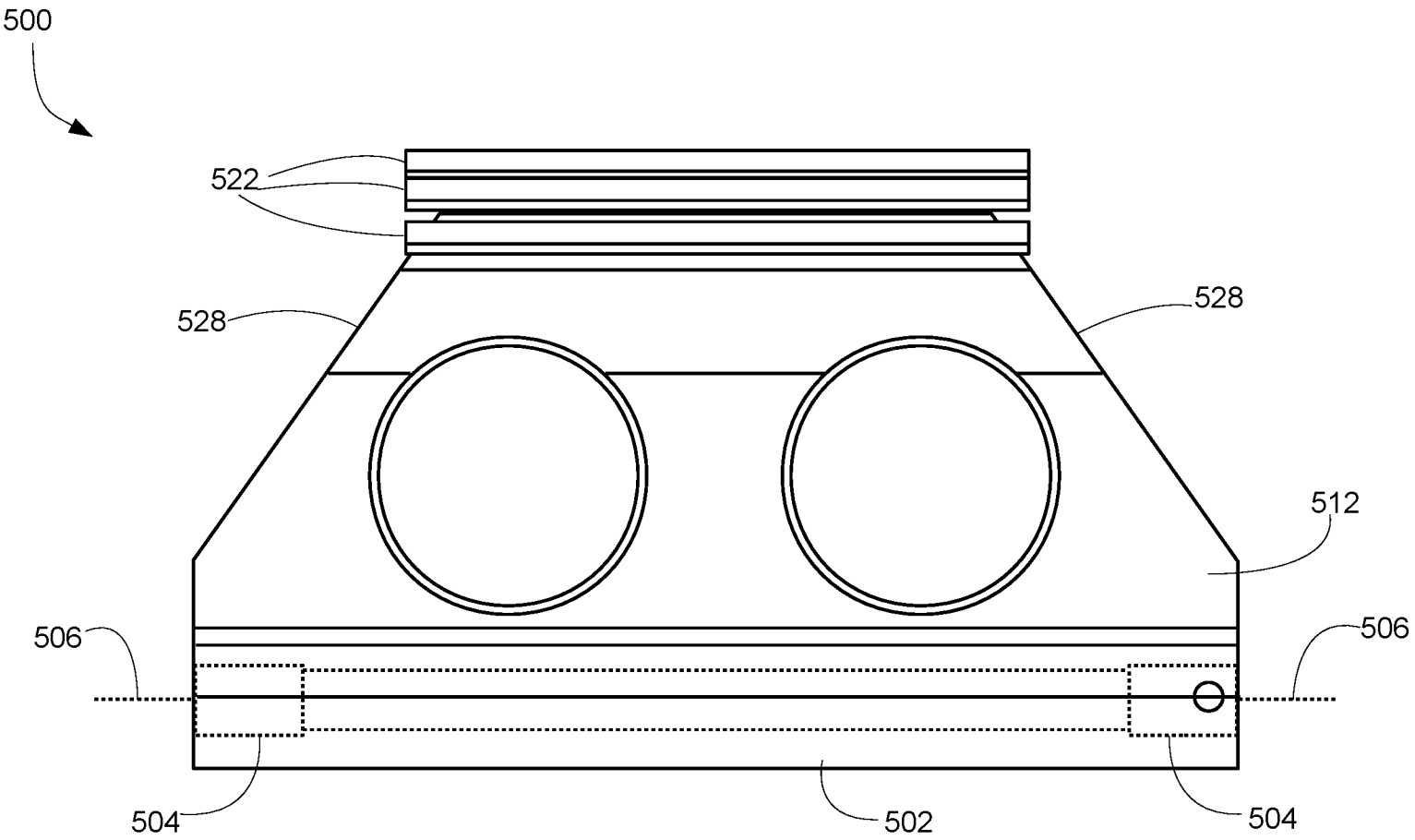
FIG. 10 illustrates a front view of the assembled three-tooth jaw of FIG. 8 prior to filing down the carbide tips.

FIGS. 8 to 10 show the jaw 500 with the carbide inserts 520 soldered into the valleys 516 prior to filing down the lengths of the carbide inserts 520 according to an exemplary embodiment of the manufacturing process. In particular, FIG. 8 illustrates a perspective view of a three-tooth jaw 500 prior to filing down the carbide inserts 520 according to an exemplary embodiment, FIG. 9 illustrates a side view of the three-tooth jaw 500 of FIG. 8 prior to filing down the carbide inserts 520, and FIG. 10 illustrates a front view of the three-tooth jaw 500 of FIG. 8 prior to filing down the carbide inserts 520. In some embodiments, the carbide inserts 520 are silver soldered into the valleys and their ends are then filed or otherwise ground off to match the trapezoid sidewall shapes of the jaw body.

Figures 11, 12:
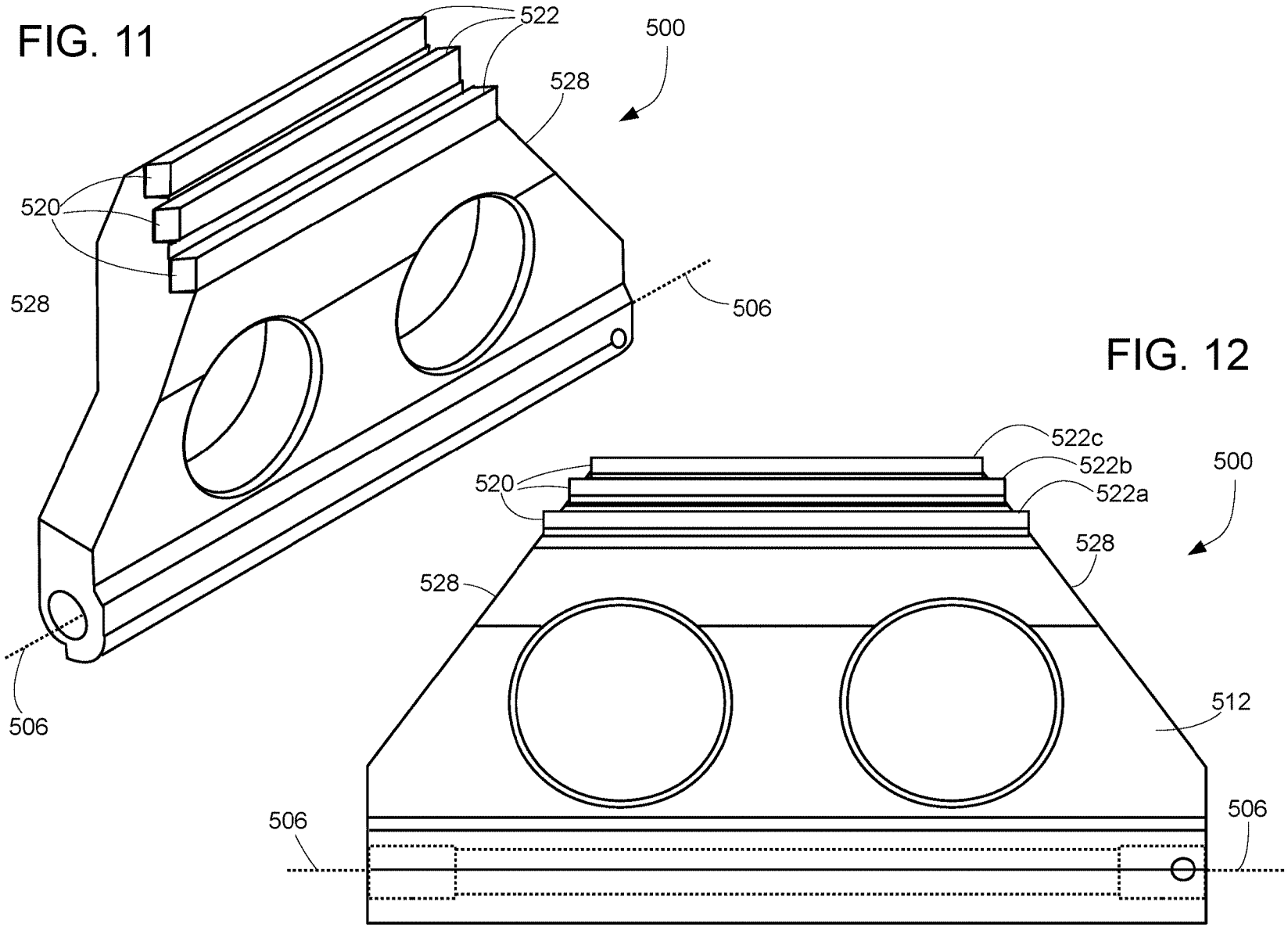
FIG. 11 illustrates a perspective view of a three-tooth jaw ready for usage after the carbide inserts are sized lengthwise to not extend past the sides jaw body according to an exemplary embodiment.
FIG. 12 illustrates a front view of the three-tooth jaw of FIG. 11 ready for usage.

FIGS. 11 to 12 illustrate the three-tooth jaw 500 after the carbide inserts 520 are sized lengthwise such as by filing off their right and left sides such that inserts 520 to fit in the valleys 516 without extending past the sides 528 of the trapezoid body 512. Sizing the carbide inserts 520 to match the trapezoid shape is useful to ensure that incidental contact of the angled side edges 528 of the jaw 500 while running and tripping out the tool chain causes the jaw 500 to pivot toward the stowed, i.e., non-interfering position.

As shown in FIGS. 11 and 12, each respective tooth line along the top of the radial tips 522 is a different length. The radial tips 522 are ordered to generally follow the trapezoidal shape such that the tip 522 line lengths are in descending order of length with the first radial tip 522*a* lower on the jaw 500 (closer to the axis of rotation 506) has a longest length and the last radial tip 522*c* higher on the jaw 500 (furthest from the axis of rotation 506) has a shortest length. In some embodiments, the carbide inserts 520 may be cut to the appropriate lengths prior to assembly and then the correctly sized inserts 520 are soldered into place in valley 516.

Figure 13:
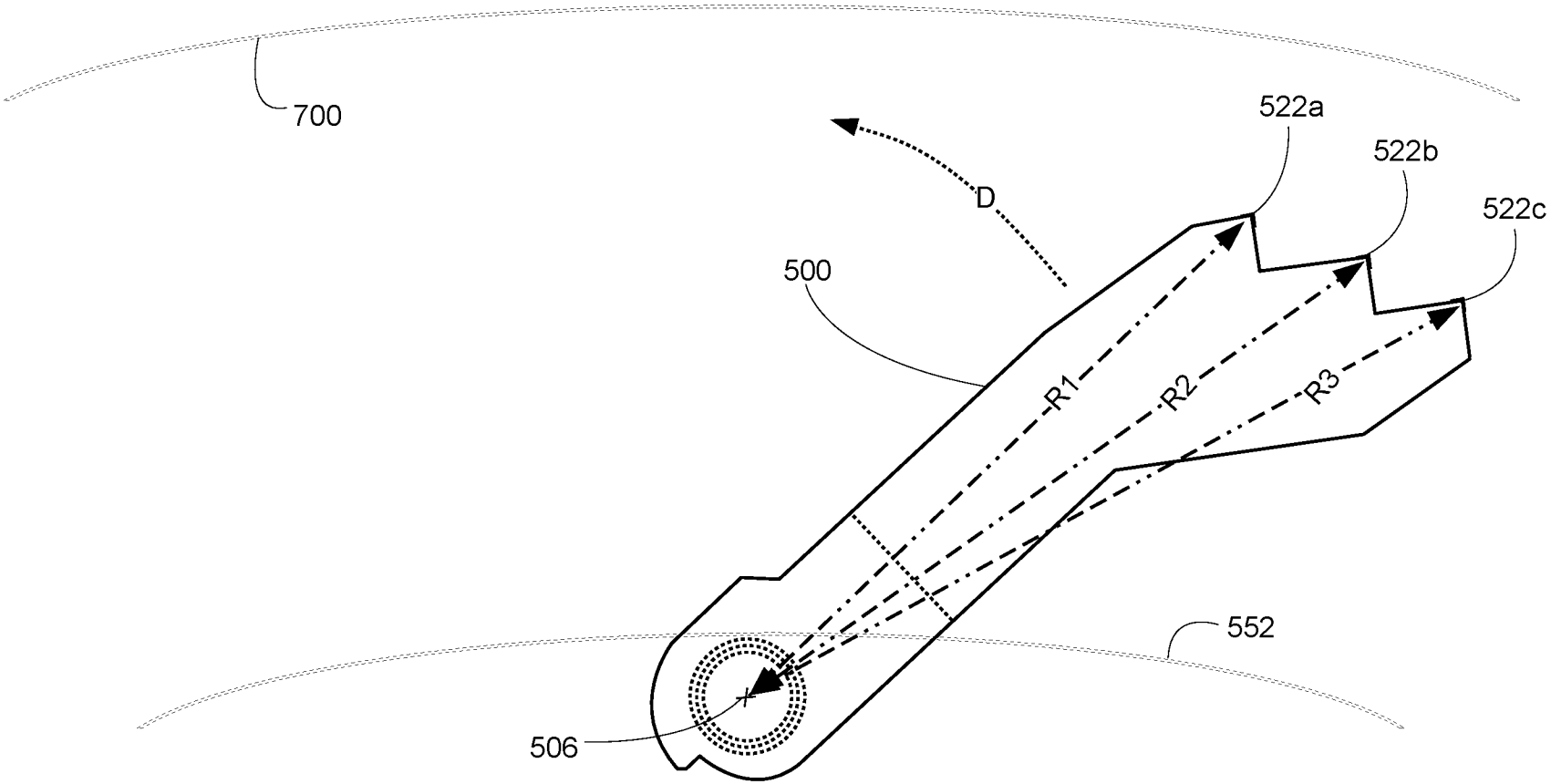
FIG. 13 illustrates a side view of a three-tooth jaw being pivoted from the outside wall of a torque stopper device into a deployed position toward the wellbore casing according to an exemplary embodiment.

FIG. 13 illustrates a side view of a three-tooth jaw 500 being pivoted away from the outside wall 552 of the torque stopper device 550 into a deployed position (moving in the D direction) toward the wellbore casing 700 according to an exemplary embodiment. The jaw 500 is viewed from the side as it would be seen when looking down the wellbore from the surface with the axis of rotation 506 being the point around which the jaw 500 pivots. This diagram firstly illustrates how the radial tips 522*a*, 522*b*, 522*c* are in an ascending order of distance to the axis of rotation 506. In particular, as the jaw 500 pivots away from the outside wall 522 of the torque stopper device 550 in the D direction, the leading radial tip 522*a* has a shortest distance R1 from the axis of rotation 506. Likewise, the middle radial tip 522*b* has a middle distance R2 from the axis of rotation 506, and the last radial tip 522*c* has the longest distance R3 from the axis of rotation 506. The radial tips 522*a,b,c* form a staircase where each successive tip 522*a,b,c* is progressively higher as the jaw 500 pivots from the stowed to the deployed position.

Figure 14:
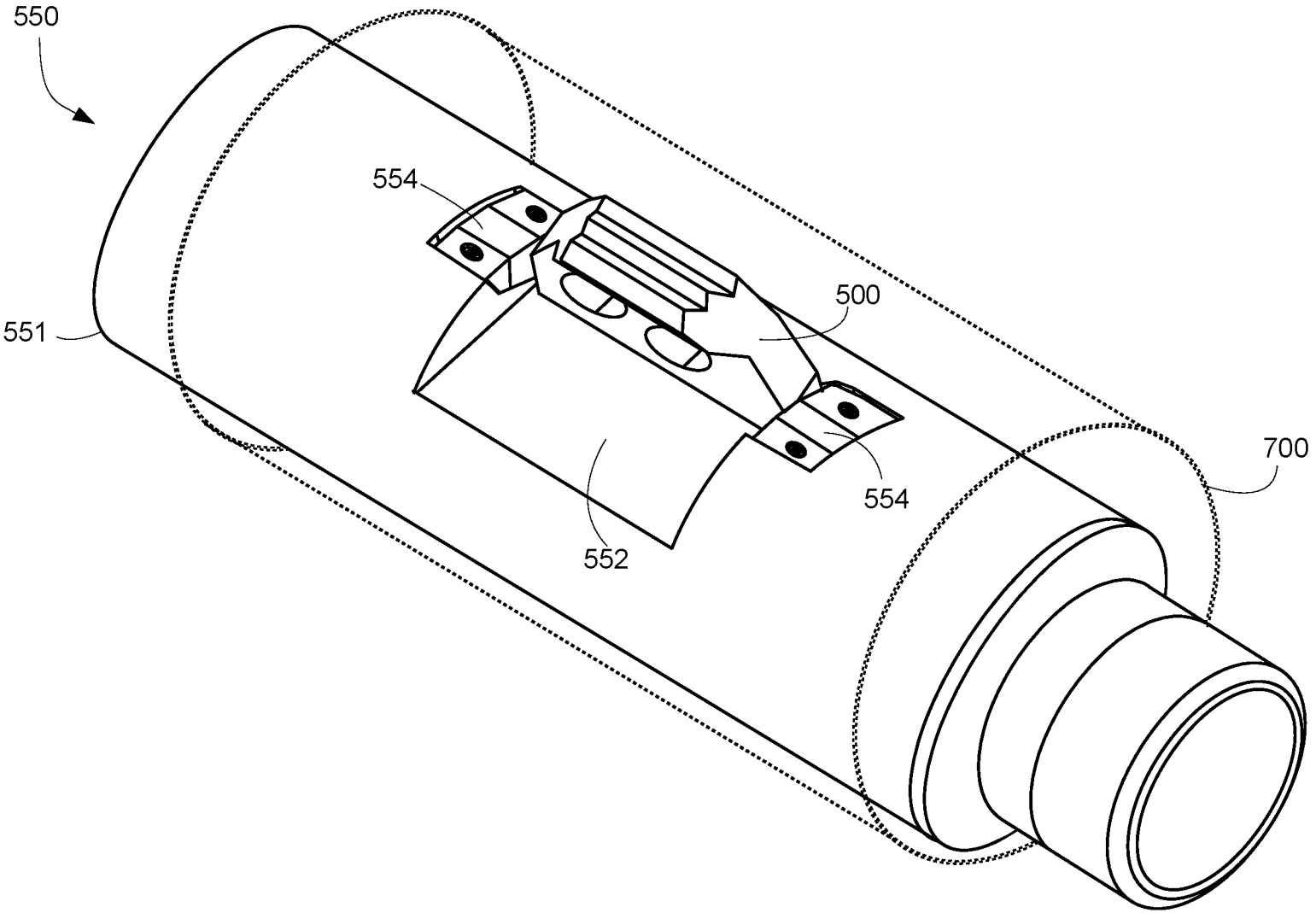
FIG. 14 illustrates a perspective view of a torque stopper device having a three-tooth jaw rotated into a deployed position toward a wellbore casing according to an exemplary embodiment.

FIG. 14 illustrates a perspective view of a torque stopper device 550 having a three-tooth jaw 500 pivoted into a deployed position toward a wellbore casing 700 according to an exemplary embodiment. As shown, first and second mounting blocks 554 hold the jaw 500 adjacent the outside housing 552 of the device 550 while allowing the jaw 500 to pivot between a stowed position where it is against the housing 552 and a deployed position as illustrated in FIG. 14. Springs (not shown) may be included within the mounting blocks 554 to automatically extend the jaw into a deployed position by pivoting it about its axis of rotation 506 as per the usual manner as described in the above-identified prior art documents. Beneficially, the torque stopper body 551 and mounting blocks 554 may be exactly the same as utilized in the prior art torque stopper device 100 with only the old jaw 102 being replaced to be a multi-tooth jaw 500 as disclosed herein.

In some embodiments, a repair kit is provided to allow operators to replace the prior art jaw 102 when the tool string is removed from the wellbore for maintenance. This may be done routinely in the field whenever the torque stopper device 100 is extracted from the wellbore. The repair kit may include all the required parts such as mounting blocks 554 and a multi-tooth jaw 500 as disclosed herein. A method of utilizing the repair kit includes firstly removing the pre-existing jaw on the torque stopper device 100, which may be a single-tooth jaw 102 according to the prior art as illustrated in FIGS. 2 to 4 for example. A new jaw being a multi-tooth jaw as disclosed herein such as a three-tooth jaw 500 shown in any of FIGS. 5 to 13 is then installed on the torque stopper device 102 thereby forming an improved torque stopper device 550, as shown in FIG. 14 for example.

Having a multi-tooth jaw 500 as disclosed herein has several advantages over the single-tooth jaw 102 of the prior art. To facilitate an understanding of advantages of certain embodiments, FIGS. 15 to 18 show examples of how torque stopper device 550 with a 3-tooth jaw 500 according to an exemplary embodiment can be utilized with a range of casing internal diameters.

Figure 15:
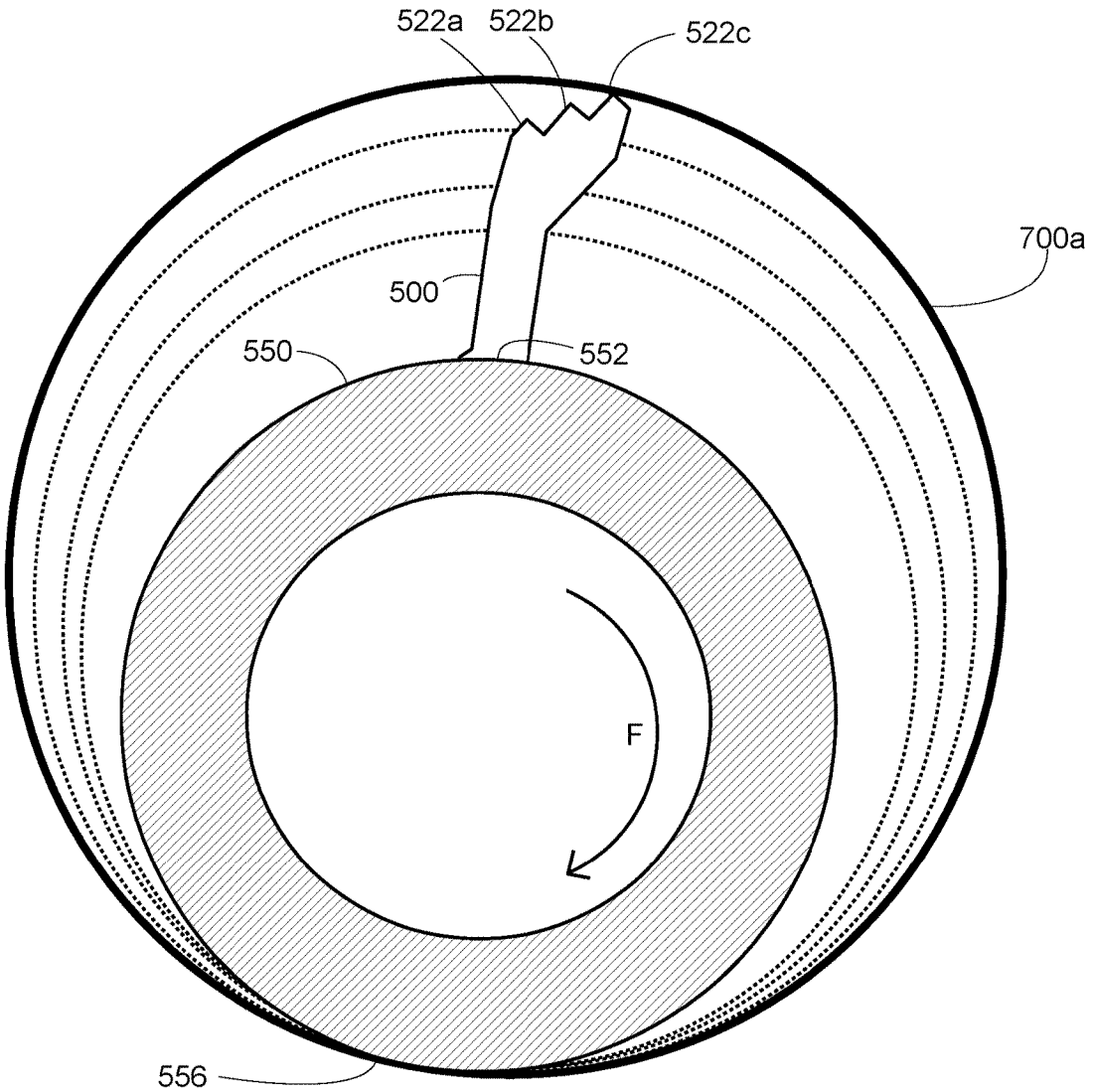
FIG. 15 illustrates a cross sectional view of a torque stopper device preventing rotation of one or more downhole tools within a casing having a first internal diameter (I.D.) according to an exemplary embodiment.

FIG. 15 illustrates a cross sectional view of a torque stopper device 550 preventing rotation of one or more downhole tools within a large internal diameter (I.D.) casing 700*a*. As illustrated, a rotational force F of the downhole tools is in the clockwise direction. This rotational force has caused the jaw 500 to almost fully extend to ninety degrees before the last radial tip 522*c* has engaged the internal surface of the casing 700*a*. The rotational force F tends to cause the jaw 500 to attempt to pivot the rest of the way to ninety degrees (perpendicular with the outside surface of the torque stopper housing wall 552), but, due to the total combined width of the extended jaw 500 and the torque stopper device 550, the opposite side 556 of the tool body 550 has engaged the casing wall 700*a* and the jaw 500 cannot further pivot. Thus, rotation is stopped and the torque stopper device 550 resists further rotation despite the continued clockwise force F.

The example of FIG. 15 may be considered to be at the upper range of the casing internal diameter where rotational prevention is successfully prevented by the torque stopper device 550. The reason is the jaw 500 is almost at ninety degrees to the torque stopper housing wall 552 and only the last tooth 522*c* has engaged the casing 700*a*.

Figure 16:
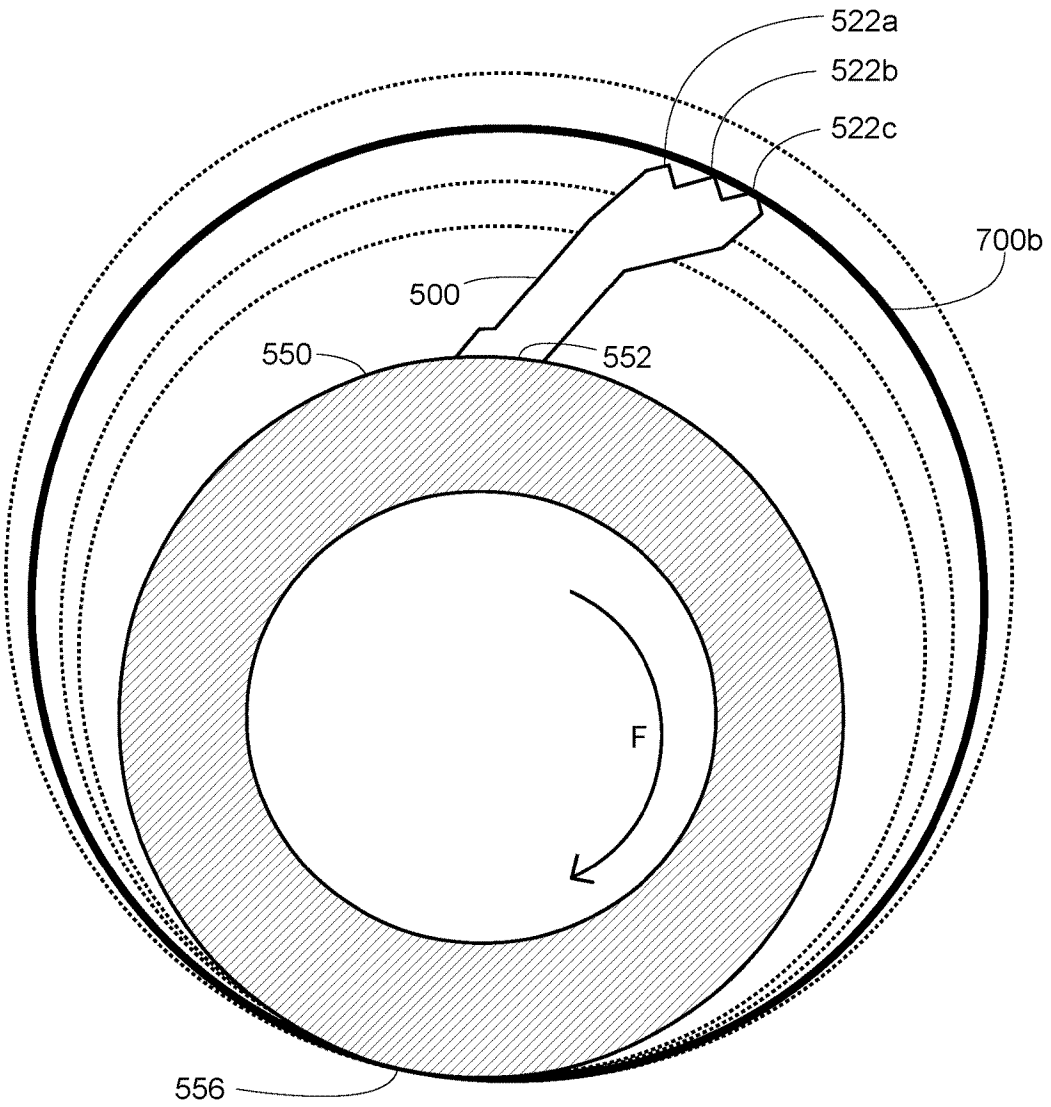
FIG. 16 illustrates a cross sectional view of a torque stopper device preventing rotation of one or more downhole tools within a casing having a second internal diameter (I.D.) according to an exemplary embodiment.

FIG. 16 illustrates the torque stopper device 550 of FIG. 15 preventing rotation of a downhole tool within a smaller internal diameter (I.D.) casing 700*b*. Beneficially, the same torque stopper device 550 can be utilized in this smaller I.D. casing. Two radial tips 522 of the 3-tooth jaw 500 are now engaged with the casing wall 700*b*. Specifically, both the highest tooth 522*c* and the middle tooth 522*b* have solid engagement with the casing wall 700*b* and the rotational force F is resisted. The internal diameter of this casing 700*b* is large enough that the lowest tooth 522*a* (the leading tooth as the jaw 500 rotates toward its deployed position) does not engage.

Figure 17:
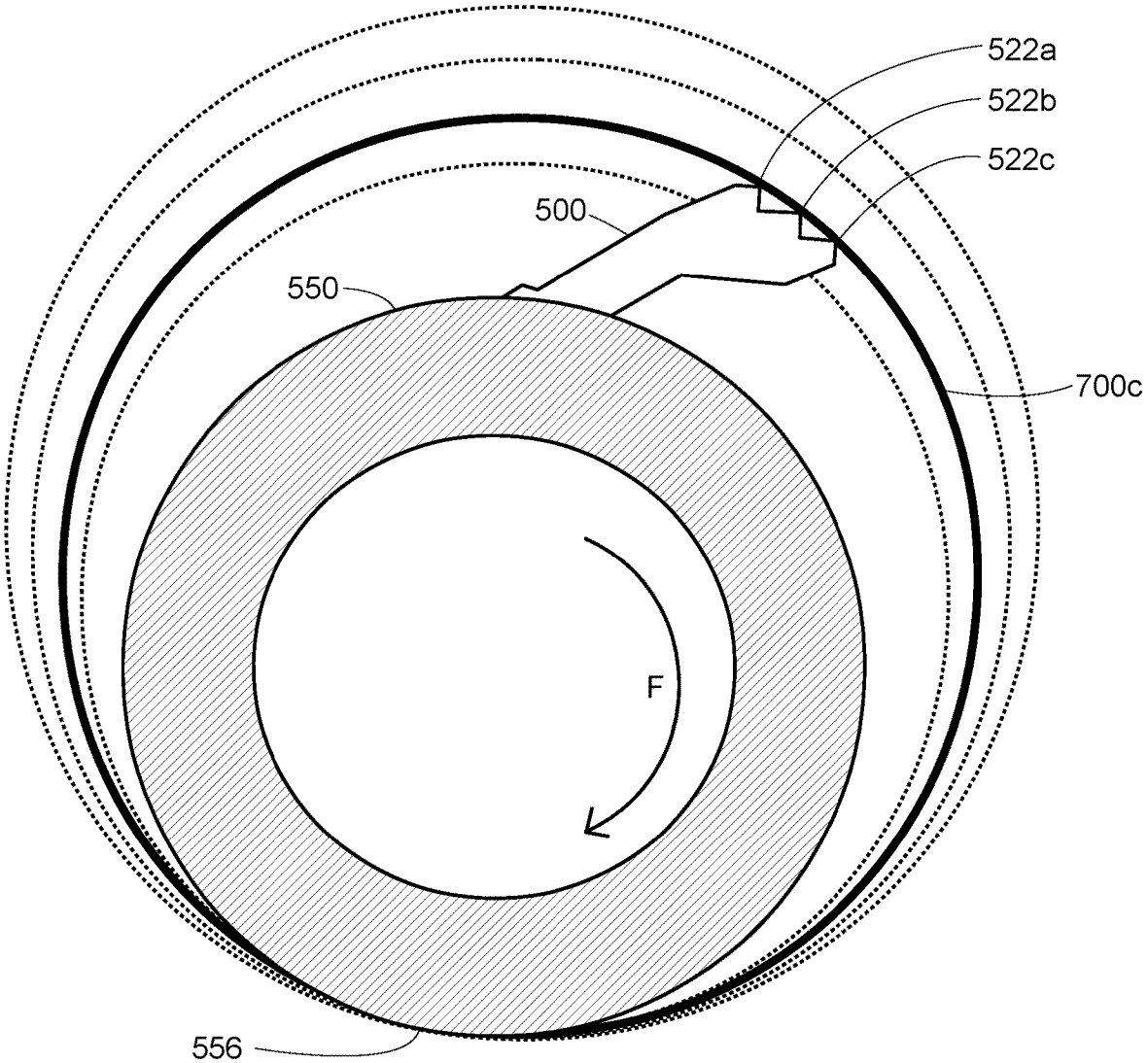
FIG. 17 illustrates a cross sectional view of a torque stopper device preventing rotation of one or more downhole tools within a casing having a third internal diameter (I.D.) according to an exemplary embodiment.

FIG. 17 illustrates the torque stopper device 550 of FIG. 16 preventing rotation of a downhole tool within an even smaller internal diameter (I.D.) casing 700*c*. Beneficially, the same torque stopper device 550 as utilized in the situations of both FIG. 15 and FIG. 16 can be utilized in this yet smaller I.D. casing 700*c*. The internal diameter of this casing 700*c* is such that all three teeth 522*a*, 522*b*, 522*c* engage the casing wall 700*c* as the jaw 500 pivots into the deployed position.

Figure 18:
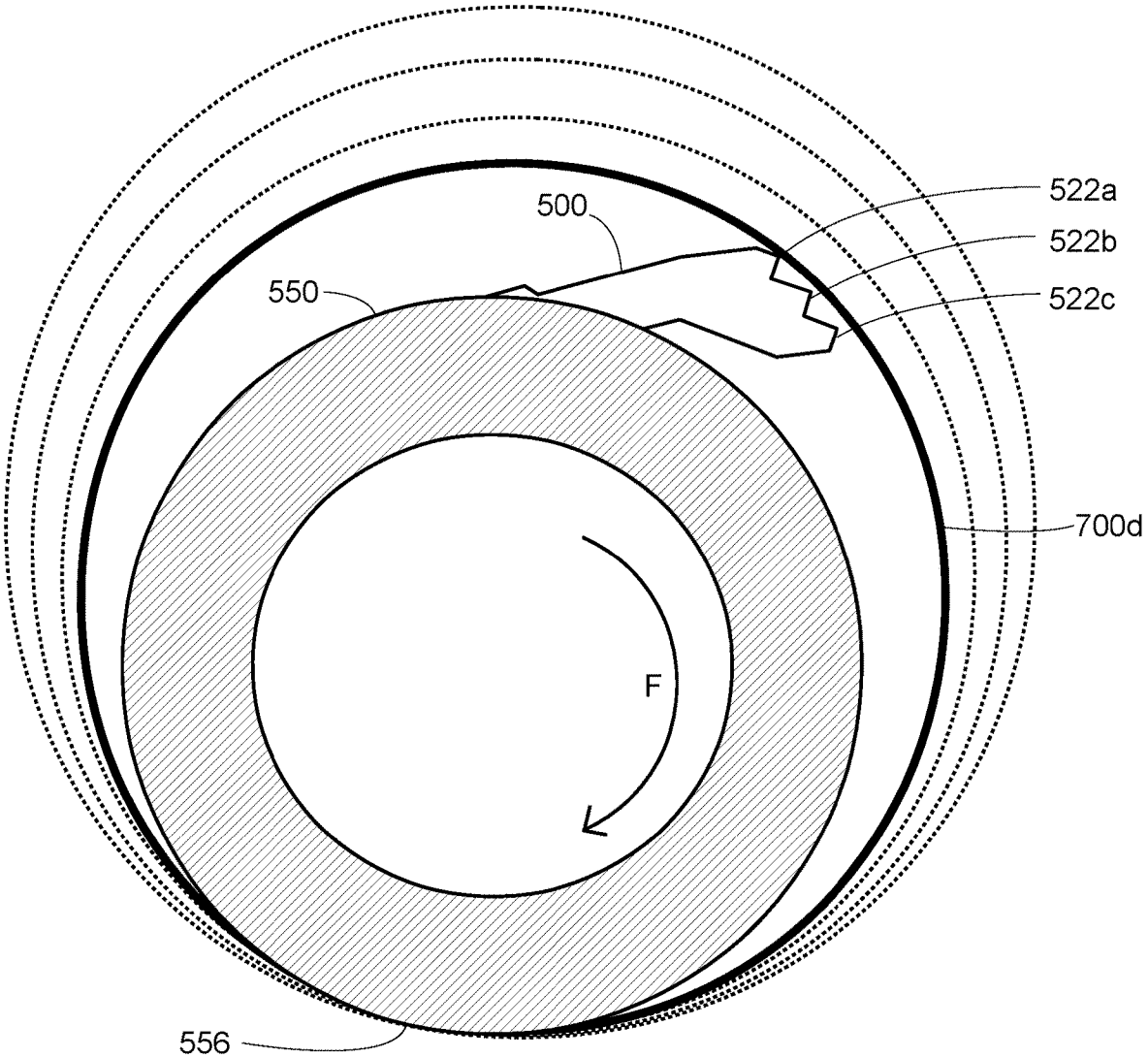
FIG. 18 illustrates a cross sectional view of a torque stopper device preventing rotation of one or more downhole tools within a casing having a fourth internal diameter (I.D.) according to an exemplary embodiment.

FIG. 18 illustrates the torque stopper device 550 of FIG. 17 preventing rotation of a downhole tool with an even smaller internal diameter (I.D.) casing 700*d*. In this example, the casing internal diameter 700*d* is small enough that only the leading tooth 522*a* catches and engages with the casing 700*d* wall before the jaw's 500 pivoting is stopped. The middle and highest radial tips 522*b*, 522*c* in this situation do not engage; however, beneficially the clockwise rotation F of the downhole tools is still stopped and the torque stopper device 550 is effective even with this smaller I.D. casing 700*d*.

Figure 19:
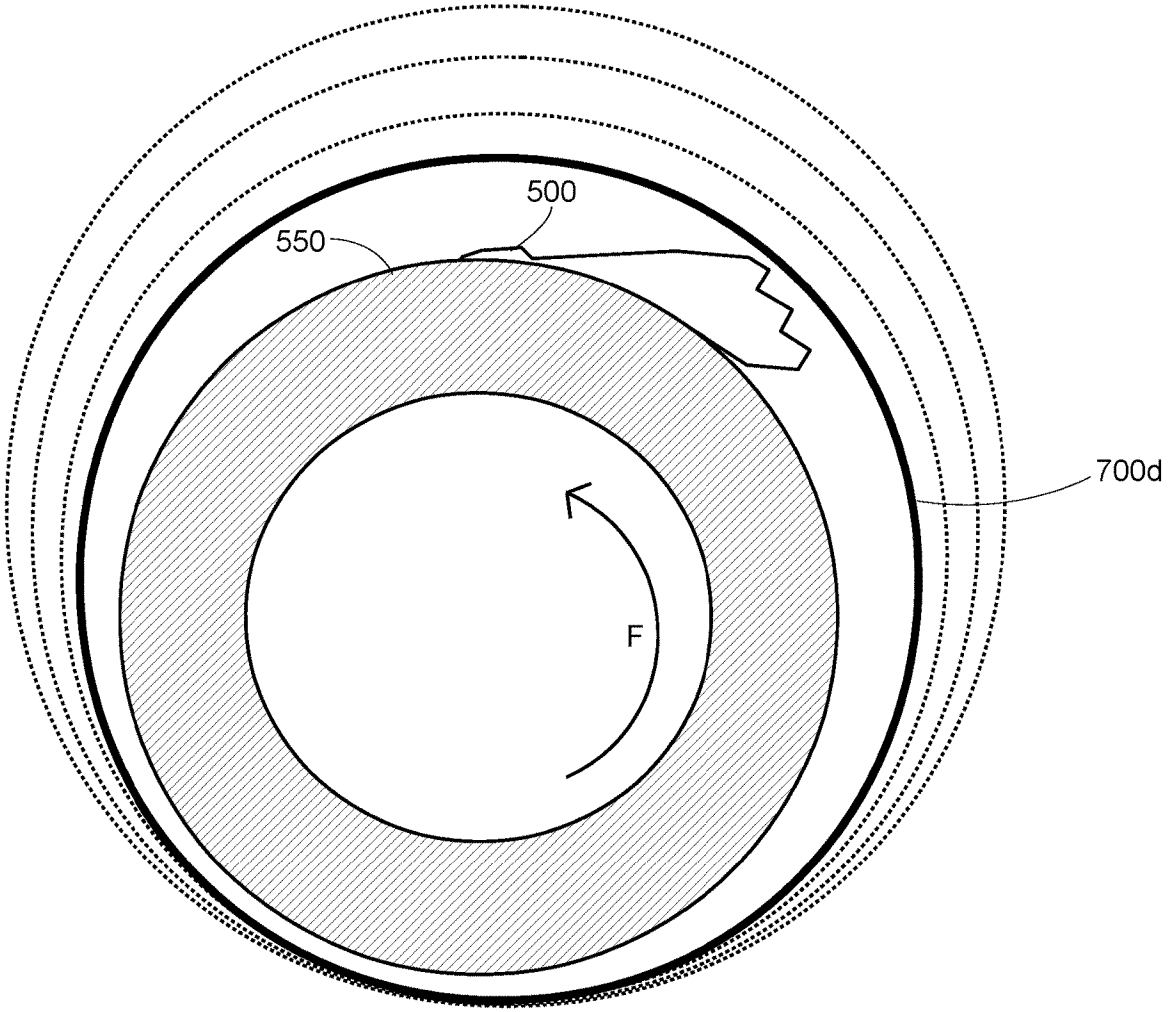
FIG. 19 illustrates a cross sectional view of a torque stopper device pivoted into a stowed position and allowing counterclockwise rotation of downhole tools within the casing when the rotational force F on the tool string is in the counterclockwise direction according to an exemplary embodiment.

FIG. 19 illustrates the torque stopper device of FIG. 18 with the 3-tooth jaw 500 pivoted toward a stowed position when the rotational force F on the tool string is in the counterclockwise direction. In the stowed position, the downhole tools are free to rotate counterclockwise in the wellbore. None of the teeth of the jaw 500 engages with the casing 700*d* and instead just glide along the surface of the casing as the tool 550 is rotated in the counterclockwise direction.

As illustrated in FIGS. 15 to 18, the torque stopper device 550 with 3-tooth jaw 500 can successfully prevent downhole tool rotation in a large range of internal diameter casings 700*a-d*. In one example, a torque stopper device 550 with 3-tooth jaw 500 as disclosed herein may successfully be deployed in any 7-inch casing 700 regardless of the range of casing weight from 17 lbs/ft all the way to 32 lbs/ft. Part ordering is simplified because a same model of torque stopper device 550 (and same accompanying model of replacement jaw 500) can be ordered for any 7-inch casing 700. Beneficially, a multi-tooth jaw 500 as disclosed herein may act as a "universal" jaw that works in any casing of a given size such as 7 inches outer diameter. A similar benefit applies to any casing size where a torque stopper device 550 with multi-tooth jaw 500 can work for that particular casing outer diameter size regardless of casing weight.

In many situations, multiple teeth 522 will engage the casing wall 700 providing a stronger engagement. Moreover, in the event a leading tooth 522*a* breaks, the following teeth 522*b,c* (at longer distances from the axis of rotation 506 of the jaw 500) may still catch. Failures are thus prevented at greater ranges of internal diameter casing 700 when compared to a single-tooth jaw 102. In yet another benefit of some embodiments, multi-teeth jaws 500 as disclosed herein can be fully compatible with existing torque stopper device bodies 100 and associated mounting blocks 554. Thus, existing single-tooth jaws 102 can easily be replaced with a multi-tooth jaws 500 as disclosed herein in the field. A repair kit may provide all the required parts to replace the old jaw 102 with a new multi-tooth jaw 500 thereby increasing the effectiveness and reliability of an existing torque stopper device 100.

According to an exemplary embodiment, a multi-tooth jaw 500 for a torque stopper device 550 prevents rotation of downhole tools suspended in a wellbore casing 700. The jaw 500 includes a base 502 for positioning adjacent an outside wall 552 of the torque stopper body 551 and a hinge connection 504 allowing the jaw 500 to pivot around an axis of rotation 506 running lengthwise through the base 502. The jaw 500 further includes a plurality of radial tips 522, i.e., teeth, each a different distance, e.g., R1, R2, R3, from the axis of rotation 506. When viewed from a side with the axis of rotation 506 being a point around which the jaw 500 pivots, the tips 522 are in ascending order of distance with a first, leading tip 522*a* having a shortest distance R1 from the axis of rotation 506 as the jaw 500 pivots from a stowed to a deployed position. A torque stopper device 550 with the multi-tooth jaw 500 supports a range of casing 700 internal diameters. A repair kit allows swapping a prior art, one-tooth jaw 102 with the multi-tooth jaw 550, 500.

Although the invention has been described in connection with preferred embodiments, it should be understood that various modifications, additions and alterations may be made to the invention by one skilled in the art without departing from the spirit and scope of the invention.

Although a multi-tooth jaw 500 having three radial tips 522*a,b,c* (i.e., three teeth) has been disclosed herein and supports a good range of casing 700 internal diameters, other embodiments are also possible. For example, a multi-tooth jaw may be formed similarly utilizing a plurality of only two radial tips 522*a,b* at different distances R1, R2 from the axis of rotation 506. Likewise, a multi-tooth jaw 500 in some embodiments may include four (or more) radial tips 522, each at different distances from the axis of rotation 506.

In some embodiments, regardless of the number of teeth (i.e., radial tips 522), the tips 522 may be ordered in ascending order of distance from the axis of rotation 506 such that a leading tip 522*a* when the jaw 500 is pivoting from stowed to deployed position has the shortest distance R1 to the axis of rotation 506. In this way, the first, leading tooth 522*a* can catch the casing 700 side when the casing internal diameter is small and the later teeth 522*b*+ are each at progressively larger distances such that they will catch the casing 700 side when the jaw 500 pivots outwards further in the event the casing 700 internal diameter is larger. However, in other embodiments, multiple radial tips 522 at a same distance from the axis of rotation 506 are provided on the jaw 500. Having multiple teeth 522 at a single level may act as a redundancy in the event one of the radial tips breaks 522 or wears down. Furthermore, having multiple teeth 522 catch the casing 700 at a same time can beneficially avoid the forces of the torque stopper disforming (i.e., "egging") the shape of the casing 700. This benefit applies regardless of whether the multiple teeth 522 that simultaneously catch the casing 700 are at different levels on the jaw 500 or at the same level.

Single elements may be separated into multiple elements, or multiple elements may be combined into a single elements. For example, in some embodiments, the radial tips 522 and the jaw body 512 may be combined into a single, integral unit. In some embodiments, the radial tips 522 are formed by the material of the jaw body 512 rather than utilizing tungsten carbide inserts 520 soldered in valleys 516. Other types of strong materials besides tungsten carbide may be utilized to form the radial tips 522.

All combinations and permutations of the above described features and embodiments may be utilized in conjunction with the invention.

What is claimed is:

1. A method of utilizing a repair kit for a torque stopper device, the torque stopper device preventing rotation of one or more downhole tools suspended in a wellbore casing, the repair kit comprising a multi-tooth jaw, the multi-tooth jaw comprising:

a base for positioning adjacent an outside wall of the torque stopper device;

a hinge connection on the base for joining with a corresponding hinge connection on the outside wall of the torque stopper device to thereby allow the multi-tooth jaw to pivot around an axis of rotation running lengthwise through the base; and a plurality of radial tips each extending laterally from the base a different distance from the axis of rotation; and the method of utilizing the repair kit comprising:

removing an old jaw having a single radial tip from the torque stopper device; and installing the multi-tooth jaw having the plurality of radial tips to the torque stopper device.

2. The method of claim 1, wherein, when the multi-tooth jaw is viewed from a side with the axis of rotation being a point around which the multi-tooth jaw pivots, the radial tips are in a sequential order of distance from the axis of rotation.

3. The method of claim 2, wherein:

the hinge connection allows the multi-tooth jaw to pivot around the axis of rotation between a stowed position and a deployed position where the multi-tooth jaw extends away from the outside wall; and when the multi-tooth jaw is viewed from the side with the axis of rotation being the point around which the multi-tooth jaw pivots, the radial tips are in an ascending order of distance with a first radial tip having a shortest distance from the axis of rotation being a leading radial tip as the multi-tooth jaw pivots from the stowed position to the deployed position.

4. The method of claim 2, wherein, when the multi-tooth jaw is viewed from the side with the axis of rotation being the point around which the multi-tooth jaw pivots, an inner side of the multi-tooth jaw for lying against the outside wall of the torque stopper device while the multi-tooth jaw is pivoted to a fully stowed position has a concave shape.

5. The method of claim 2, wherein, when the multi-tooth jaw is viewed from the side with the axis of rotation being the point around which the multi-tooth jaw pivots, an outer side of the multi-tooth jaw facing the wellbore casing while the multi-tooth jaw is pivoted to a fully stowed position has a convex shape.

6. The method of claim 2, wherein each of the radial tips extends along a respective line that is parallel to the axis of rotation.

7. The method of claim 6, wherein each respective line is a different length, the radial tips having lengths that are in descending order of length with a radial tip being a shortest distance from the axis of rotation having a longest length.

8. The method of claim 1, wherein each of the radial tips is formed by a carbide tip insert.

9. The method of claim 1, wherein the plurality of radial tips includes a total of three radial tips.

* * * * *